US011170613B2

(12) United States Patent
Al-Ziyoud

(10) Patent No.: US 11,170,613 B2
(45) Date of Patent: Nov. 9, 2021

(54) LOTTERY SYSTEM AND METHOD WITH REAL-TIME PROGRESSIVE JACKPOT

(71) Applicant: ZYOUD VISION HOLDING, Beirut (LB)

(72) Inventor: Aiman H. Al-Ziyoud, Abu Dhabi (AE)

(73) Assignee: ZYOUD VISION HOLDING, Beirut (LB)

( * ) Notice: Subject to any disclaimer, the term of this patent is extended or adjusted under 35 U.S.C. 154(b) by 261 days.

(21) Appl. No.: 15/236,204

(22) Filed: Aug. 12, 2016

(65) Prior Publication Data

US 2017/0039800 A1 Feb. 9, 2017

Related U.S. Application Data

(63) Continuation of application No. 10/556,201, filed as application No. PCT/IB2004/001870 on May 7, 2004, now abandoned, which is a continuation-in-part of application No. 10/434,283, filed on May 9, 2003, now abandoned.

(51) Int. Cl.
*G07F 17/32* (2006.01)

(52) U.S. Cl.
CPC ..... *G07F 17/329* (2013.01); *G07F 17/32* (2013.01); *G07F 17/3211* (2013.01); *G07F 17/3225* (2013.01); *G07F 17/3241* (2013.01); *G07F 17/3258* (2013.01)

(58) Field of Classification Search
CPC .... G07F 17/32; G07F 17/329; G07F 17/3211; G07F 17/3241
USPC ..... 463/16, 17, 42
See application file for complete search history.

(56) References Cited

U.S. PATENT DOCUMENTS 4,756,020 A * 7/1988 Fodale ..... H04M 3/4228 379/114.01
4,893,330 A * 1/1990 Franco ..... H04M 3/38 379/114.14
5,210,789 A * 5/1993 Jeffus ..... H04M 3/51 379/122
5,354,069 A * 10/1994 Guttman ..... G07C 15/006 273/269
5,950,121 A * 9/1999 Kaminsky ..... H04W 12/06 455/410
6,024,641 A * 2/2000 Sarno ..... G07F 17/32 463/17
6,282,276 B1 * 8/2001 Felger ..... G06Q 20/12 379/114.19
6,527,638 B1 * 3/2003 Walker ..... G07F 17/32 463/25
6,685,562 B1 * 2/2004 Rantanen ..... A63F 3/081 463/17
7,035,626 B1 * 4/2006 Luciano, Jr. ..... G07F 17/32 455/414.1

(Continued)

*Primary Examiner* — Chase E Leichliter
(74) *Attorney, Agent, or Firm* — Oblon, McClelland, Maier & Neustadt, L.L.P.

(57) ABSTRACT

Systems and methods for facilitating the purchase of lottery tickets and the dissemination of lottery information in real time. A central lottery system is provided that accepts lottery ticket purchasing orders from a remote terminal. The central lottery system may keep track of a progressive jackpot and disseminate the latest jackpot size information to communication presentation devices via various communication links.

28 Claims, 8 Drawing Sheets

(56) References Cited

U.S. PATENT DOCUMENTS

| | | | | |
|---|---|---|---|---|
| 7,100,822 | B2 * | 9/2006 | Piper | G06Q 30/02 235/381 |
| 2001/0013054 | A1 * | 8/2001 | Okawa | H04L 12/1822 709/204 |
| 2002/0010649 | A1 * | 1/2002 | Lee | G06Q 40/00 463/17 |
| 2002/0013761 | A1 * | 1/2002 | Bundy | G06Q 40/04 705/37 |
| 2002/0165020 | A1 * | 11/2002 | Koyama | G07F 17/32 463/17 |
| 2003/0182194 | A1 * | 9/2003 | Choey | G06Q 20/20 705/16 |
| 2003/0190908 | A1 * | 10/2003 | Craven | H04M 3/42229 455/411 |
| 2003/0216962 | A1 * | 11/2003 | Heller | A63F 13/75 705/318 |
| 2003/0236835 | A1 * | 12/2003 | Levi | H04L 51/36 709/204 |
| 2004/0002355 | A1 * | 1/2004 | Spencer, II | G06Q 30/02 455/550.1 |
| 2004/0050929 | A1 * | 3/2004 | Fayfield | G06Q 20/4037 235/380 |
| 2004/0093281 | A1 * | 5/2004 | Silverstein | G06Q 20/24 705/26.8 |
| 2004/0097283 | A1 * | 5/2004 | Piper | G06Q 30/02 463/17 |

* cited by examiner 402
500
502
404
NO
INPUT TERMINAL
REJECT
NO
408
AUTHENTICATION MODULE
410
LOTTERY PARTICIPATION NUMBER PROCESSING
412
VERIFICATION MODULE
414
BUFFER
CONFIRMATION
418
LOTTERY CENTRAL SERVER
BILLING
416
420
JACKPOT
406
DATA
422
DISPLAY
422
DISPLAY
422
DISPLAY

LOTTERY SYSTEM AND METHOD WITH REAL-TIME PROGRESSIVE JACKPOT

CROSS-REFERENCE TO RELATED APPLICATIONS

This application is a continuation of U.S. patent application Ser. No. 10/556,201, filed on Mar. 7, 2007, which is a U.S. National Stage Entry (371) of PCT/IB04/01870, filed on May 7, 2004, which is a continuation-in-part of U.S. patent application Ser. No. 10/434,283, filed on May 9, 2003, now abandoned, which are incorporated herein by reference in their entirety to the full extent permitted by law.

FIELD

This invention relates generally to lotteries and other games of chance, and more particularly to electronic lottery systems and methods with a real-time progressive jackpot.

BACKGROUND

In recent years, lotteries have enjoyed increasing popularity with the masses. For both private and public organizations who run the lotteries, including local and state governments, it is a relatively simple way of generating revenue. For those who pay to participate in the lotteries by waging money, it is about the classic dream of obtaining unexpected rewards and instant wealth.

With the increasing popularity of lotteries, the number and types of lotteries have also multiplied over the years. One type of lottery, for example, is an instant lottery. One example of an instant lottery is a "scratch and win" game. In this type of lottery, a customer can go to an authorized lottery ticket agent, typically a retail location such as a convenience store, gas station, or other facility, and purchase one or more of this type of lottery ticket. Once a ticket is purchased, a customer may scratch off a portion of the ticket to reveal information relating to whether the customer has won or not. In most cases, if a customer wins, he or she may instantly redeem the ticket for a prize. Examples of prizes may include cash, additional lottery tickets, or other prizes. For some large prizes, other redemption techniques may be used.

Another example of a lottery is a periodic lottery. In this type of lottery, customers may purchase lottery tickets, typically at a convenience store, gas station, or other facility associated with an authorized lottery ticket agent, during a pre-determined time period. At the end of the pre-determined time period, a drawing may be held to determine who, if anyone, has won the lottery. Periodic lotteries may be held on a daily, weekly, bi-weekly, or other periodic basis.

Lotteries, including periodic lotteries, may have progressive accumulating jackpots. A progressive accumulating jackpot grows as the number of lottery tickets sold increases. A portion of the purchasing price of a lottery ticket may go to the jackpot, thus resulting in a bigger jackpot with the sale of each lottery ticket. A progressive accumulating jackpot may continue to grow until the drawing date of the lottery. If one or more winners are selected during a drawing, the jackpot may be divided among those winners. If, however, no winner is declared at the drawing, the jackpot may be allowed to continue growing as more lottery tickets are sold. Only when a winner or winners are declared may the jackpot be distributed to the winners.

The popularity of any particular lottery may depend on several factors. One factor, for example, is the value of the prizes or jackpots. The total value of progressive accumulating jackpots typically rises as the number of lottery tickets sold increases. As the size of the jackpot increases, generally, the more attractive the lottery becomes to the general public. Of course, it may simply not be enough to have big jackpots or prizes to increase the sale of lottery tickets. That is, to fully capitalize on the marketing value of having a large jackpot, information about the size of the jackpots may be readily available to the public, preferably in a timely manner. Unfortunately with many of today's current lotteries, such information is not always readily available to the public since there may be limited means of disseminating such information. These and other drawbacks exist with existing lottery systems.

SUMMARY

In a general sense aspects of the invention is directed to systems and methods for collecting lottery-related or other data from the public, processing and/or storing the data, and disseminating the collected data and/or any resulting data to the public in real time. Data from the public may be continuously collected from remote terminals and processed, with the results presented to the public continuously or semi-continuously in, for example, a ticker-type format via private and/or public communication presentation devices. The systems and methods may be used in circumstances wherein it may be desirable to provide information relating to data provided by the public that is updated on a constant or semi-constant basis.

According to one aspect of the invention, lottery systems and methods with real-time progressive jackpots is provided. Other aspects of the invention relate to methods for customers to more conveniently participate in lotteries, and to monitor progressive jackpot information in real time. Other aspects of the invention include systems and methods for accomplishing one or more of facilitating the sale of lottery tickets, enhancing the lottery experience, enhancing the value of advertisements, television programming, and/or web pages in connection with a lottery.

According to one aspect of the invention, customers may participate in a lottery using a remote terminal which may be connected to a central lottery system via a communication link. The remote terminal may comprise any suitable communication device. The remote terminal may communicate with a central lottery system via a first communication link. The first communication link may include one or more of a communication network such as the Internet, an Intranet, a Local Area Network (LAN), a Wide Area Network (WAN), a Public Switched Telephone Network (PSTN), and/or other communication networks in combination therewith. The first communication link may use one or more communication media such as fiber optics, co-axial cable, telephone lines, microwave transmission, satellite communication, radio, telephone and television wireless transmission, or other communication media. The central lottery system may provide updated information relating to the lottery to a communication presentation device via a second communication link. The second communication link may comprise any type of communication technique or combination of techniques used to transmit data. The communication presentation device may comprise any device capable of relaying changing or evolving data to the public.

According to another aspect of the invention, the remote terminal may comprise an electronic communication device such as, for instance, a telephone, a cellular telephone, a personal digital assistant (PDA), a computer device such as a personal computer (PC), or any other remote electronic communication device. One advantage of the invention is that it avoids the need for customers to physically travel to or have a friend or an agent travel to a retail or other location to purchase one or more lottery tickets. An embodiment of the invention may enable customers and potential customers to participate in a lottery by allowing them to buy lottery tickets through the remote terminals.

According to another aspect of the invention, customers may purchase lottery tickets via telephone. For example, to purchase a lottery ticket, a customer may call a designated lottery telephone number and provide certain personal, purchasing, or other information. Such information may include a customer ID, password, number of lottery tickets desired, and lottery numbers. The lottery numbers may be determined by the customer, or may be randomly generated at the customer's request. Lottery numbers may comprise any combination of numbers, letters, or other symbols. The designated lottery telephone number may be a toll number such as a 900 number (whereby customers may be charged a minimum fee in addition to per minute charges), a toll-free number such as an 800 number, or other long distance, local access, or other number. If a 900-type telephone number is used, all or a portion of the telephone fees may be credited towards the purchase of the lottery tickets.

According to another aspect of the invention, customer orders for lottery tickets may be entered into the central lottery system manually, or by automated or semi-automated techniques. For example, a person manning an input terminal may take customer orders and manually input the customer order information into the input terminal. Alternatively, or in combination with manual techniques, a speech recognition system and/or other fully automated or semi-automated systems may be used to take orders.

According to another aspect of the invention, the remote terminal may be a public or a private remote terminal device such as a public or private telephone.

According to another aspect of the invention, the remote terminal may comprise a computer device. A customer may send an email message or other form of electronic message to the central lottery system. The message may include relevant information such as a lottery number determined by the customer, a user ID, a password, or other information.

According to another aspect of the invention, a customer may purchase a lottery ticket by using a computer device and logging onto a web page. The customer may participate in the lottery by entering relevant information such as, for example, lottery participation numbers, a user ID, a password, or other information through the web page.

According to another aspect of the invention, actual sales of lottery tickets may not be required. Instead, customer-determined lottery participation numbers may be entered by customers, thus allowing customers to determine their own lottery numbers rather than being assigned a pre-determined or randomly generated lottery number. A customer may also request that randomly generated lottery numbers be assigned to them.

According to another aspect of the invention, the communication presentation device may comprise a display device. The display device may comprise any type of public or private display device such as televisions, computer monitors, PDAs, cell phones, billboards, interactive displays at retail locations (e.g., gas pumps, elevator displays), or other displays.

According to another aspect of the invention, the communication presentation device may comprise an audio communication device such as, for example, a radio.

According to another aspect of the invention, the second communication link may be the same or of the same type of communication link as the first communication link.

According to another aspect of the invention, the second communication link may be a link established via television, radio, satellite, cable, or via optical signals, or any other suitable link.

According to another aspect of the invention, the second communication link may comprise a network such as the Internet, Intranet, LAN, WAN, PSTN, or other communication network.

According to another aspect of the invention, updated information relating to lottery prizes such as a progressive lottery, for example, may be presented in multiple ways. The latest value of a jackpot may be viewed in different mediums such as a television show or channel, a television commercial, a web browser, a web advertisement, a web page, or any other suitable media. The updated information may be displayed in various formats including formats that continuously display the most recent value of the jackpot. For example, updated information may be displayed as a running ticker, which shows the current size of a progressively accumulating jackpot at any given moment in time. The updated information may also be shown on a periodic basis. Other types of lottery prizes may also be presented, such as prizes which may change during the course of the lottery. To this end, one or more embodiments of the invention provide systems and methods that fully capitalizes on the marketing value of large jackpots by allowing customers and potential customers to have easy access to information relating to jackpot sizes in real-time.

According to another aspect of the invention, a central lottery system is provided comprising an input terminal for communicating with a remote terminal, a database for storing various types of data including data relating to progressive jackpots and customer profiles, and a lottery central server capable of disseminating jackpot information to a communication presentation device.

According to another aspect of the invention, the central lottery system may account for sales of lottery tickets from both remote terminals and conventional lottery purchasing sites (e.g., convenience stores) to determine a lottery jackpot. The jackpot lottery server system may combine portions of sales from both remote terminal sales and sales of lottery tickets through conventional retail sites (e.g., convenience stores) to determine running jackpot totals. Alternatively, the system according to the invention may be a stand alone system wherein only sales from remote terminals are counted when determining jackpot totals. The running total for the jackpot may then be presented on a ticker or in other formats through the communication presentation device.

According to another aspect of the invention, the input terminal may be an electronic input device manned by a person, or may be semi-automated or completely automated using, for example, a speech recognition application.

According to another aspect of the invention, the input terminal may comprise a computer device.

According to another aspect of the invention, the data being disseminated may comprise updated jackpot data.

According to another aspect of the invention, the lottery central server may be an electronic device capable of transmitting data through a communication link such as the Internet, Intranet, LAN, WAN, PSTN, or other communication link.

According to another aspect of the invention, the central lottery server may be capable of transmitting data through various media such as television, radio, satellite, cable, optical, or other types of data transmission media.

According to another aspect of the invention, the central lottery server may be capable of transmitting data through various media, and displaying the data on various mediums such as web browsers, web advertisements, television channels and shows, billboards, stadium scoreboards, or other forms of media.

According to another aspect of the invention, the central lottery server may be capable of transmitting data to a third party. The third party may then relay the data to the public in various media such as television and web advertisements, television shows, web browsers, or other forms of media.

Additional features and advantages of aspects of the invention are set forth in the description that follows, and in part are apparent from the description, or may be learned by practice of aspects of the invention. The objectives and other advantages of aspects of the invention are realized and gained by the structure particularly pointed out in the written description and claims thereof as well as the appended drawings.

It is to be understood that both the foregoing general description and the following detailed description are illustrative and explanatory and are intended to provide further explanation of aspects of the invention as claimed.

DETAILED DESCRIPTION OF EMBODIMENTS

Aspects of the invention are directed to systems and methods for receiving lottery-related data from the public, processing and/or storing the data, and distributing the data and/or any other data derive therefrom to the public in real time.

Figure 1A:
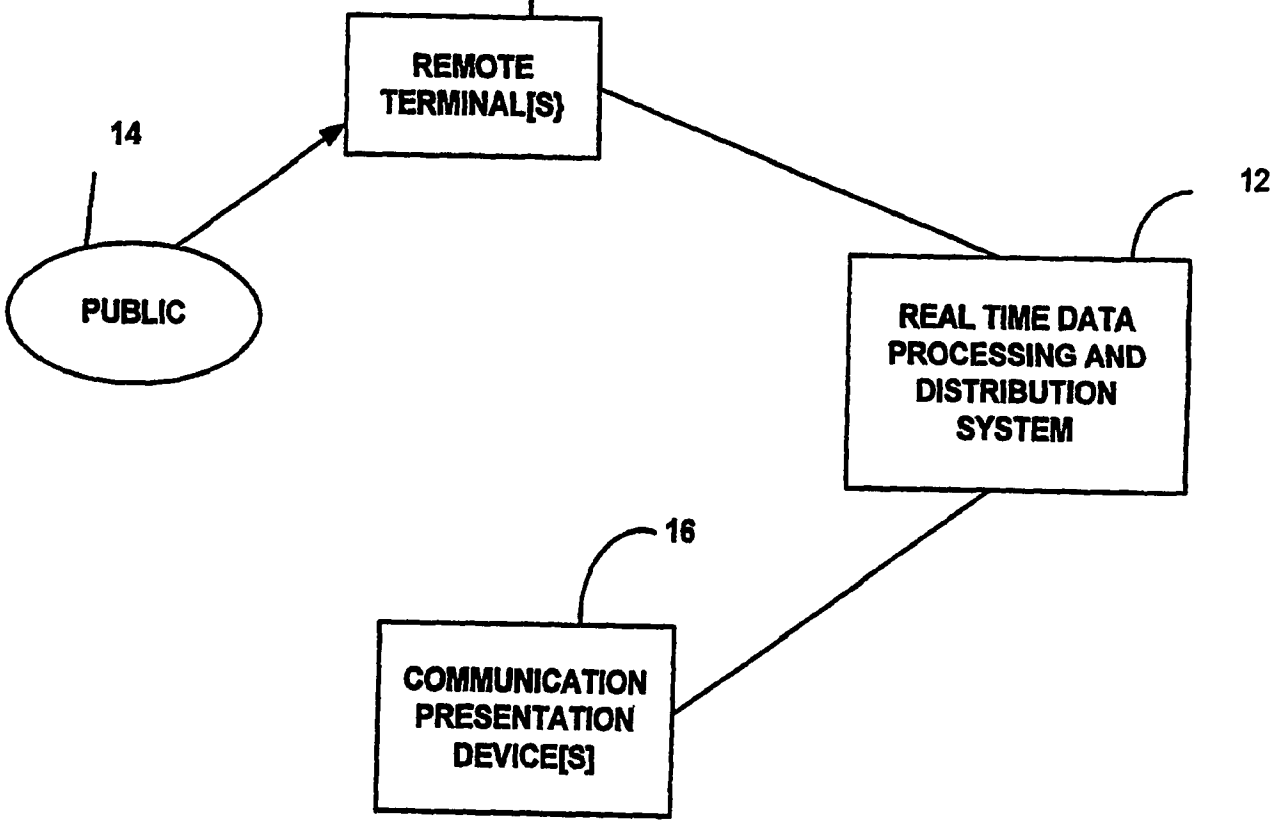
FIG. 1A is a block diagram depicting a real time data processing and distribution system for collecting data from the public and disseminating information to communication presentation devices, according to an embodiment of the invention.

FIG. 1A is a block diagram 10 depicting a real-time data processing and distribution system 12 that may receive data from the public 14 via one or more remote terminals 18, process and/or store the data, and then disseminate the data and/or any other data resulting from the processed data to the public 14 via one or more communication presentation devices 16. Remote terminals 18 may comprise any type of communication devices such as, for example, telephones, PCs, PDAs, or other devices for relaying data. System 12 may take the data obtained from the public 14 and parse and/or process it. After parsing and/or processing the data, system 12 may then disseminate the data (and/or any other data derived from the data provided by the public) back to the public 14 using one or more communication presentation devices 16. Communication presentation devices 16 may comprise televisions, radios, stadium scoreboards, or other forms of presentation devices. The information provided to communication presentation devices 16 may be in a ticker-type format such as, for example, rolling displays typically used for displaying stock market prices on television news programs.

According to an embodiment of the invention, systems and methods for enabling lottery customers to remotely participate in a lottery and for presenting continuously changing lottery data to the public in real time are provided. To participate in a lottery, a prospective lottery customer may use a remote terminal to enter a lottery number determined by the customer. The public may then keep track of the most up-to-date information relating to lottery prizes such as jackpots of progressive accumulating jackpots through publicly or privately available communication presentation devices.

Figure 1B:
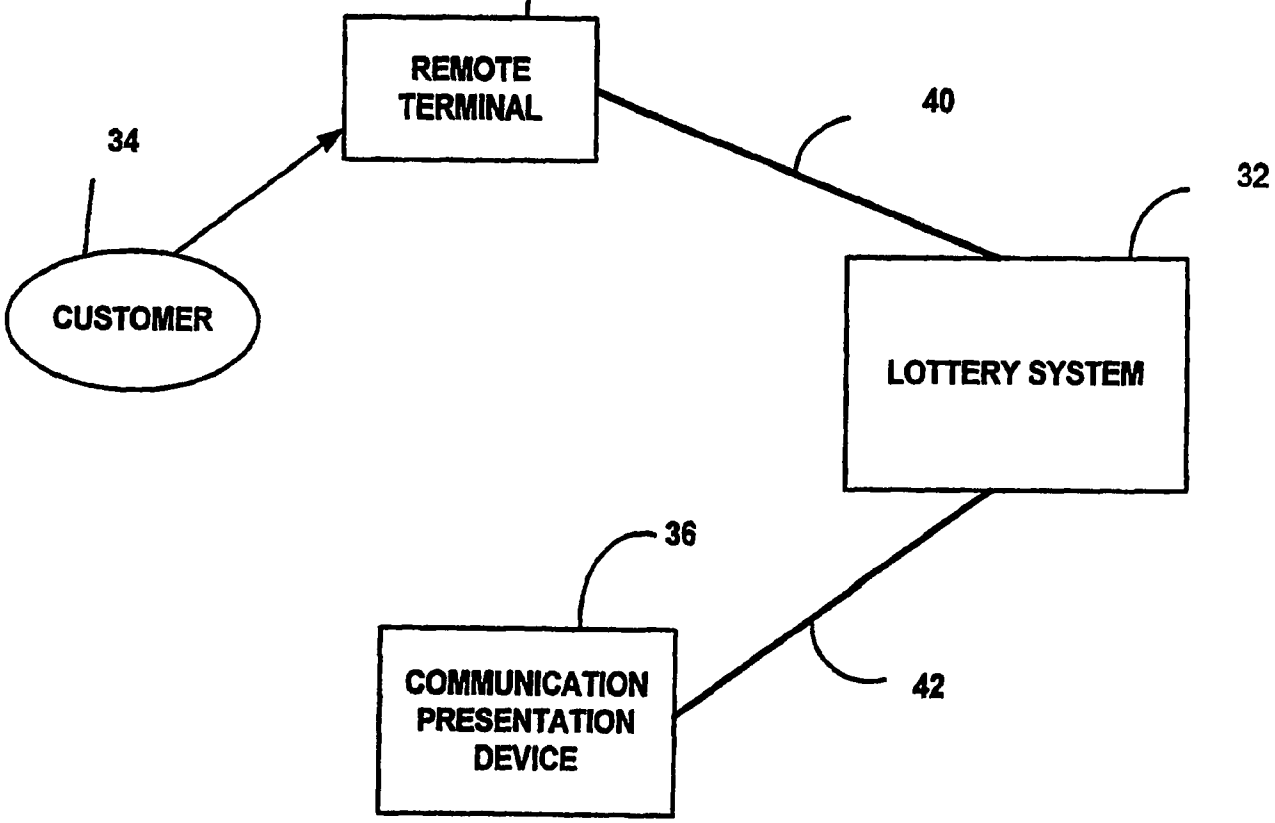
FIG. 1B is a block diagram depicting a jackpot lottery system in an illustrative environment, according to an embodiment of the invention.

FIG. 1B is a block diagram 30 depicting a lottery system 32 in communication with one or more lottery customers 34, according to one embodiment of the invention. In one embodiment, lottery system 32 is capable of transmitting updated jackpot information to a communication presentation device 16. A customer 34 wishing to participate in a lottery may enter the lottery by contacting a lottery system 32 using a remote terminal 38.

According to an embodiment, remote terminal 38 may not be a dedicated remote terminal such as those found in conventional lottery purchasing sites (e.g., convenience stores). Rather, remote terminal 38 may comprise any remote terminal device used for communication, such as any communication device that can operate independently from lottery system 32. For instance, remote terminal 38 may comprise a telephone, a cellular telephone, a PDA, a laptop, a desktop computer, or other communication device. Remote terminal 38 may further comprise either a private or a public device such as a private or public telephone or computer terminal. Remote terminal 38 may communicate with lottery system 32 via a communication link 40. Communication link 40 may be a communication network such as the Internet, an Intranet, a LAN, a WAN, the PSTN, or any other network capable of transporting data, using a communication media such as fiber optics, co-axial cable, telephone lines, microwave transmission, satellite communication, radio, telephone and television wireless transmission, or other transmission links or a combination thereof.

Lottery system 32 may continuously or periodically disseminate updated information on lottery prizes such as lottery jackpots to one or more communication presentation devices 36 via a communication link 42. Communication link 42 may be different or similar to communication link 40. In certain embodiments, communication link 42 may comprise the same communication link as communication link 40.

Communication presentation device 36 may comprise any type of communication device capable of displaying or relaying changing data. For instance, such a device may include a television, a computer monitor, a PDA display, a cellular telephone display, or other device capable of disseminating dynamic data such as the size of a progressive lottery jackpot. Communication presentation device 36 may also comprise a kiosk, billboard, stadium scoreboard, or other display. Alternatively, communication presentation device 36 may comprise communication interfaces capable of presenting the type of information provided by lottery system 32 in various formats such as, for instance, radio. That is, dynamic data may instead be presented through a communication device capable of relaying such data.

Figure 1C:
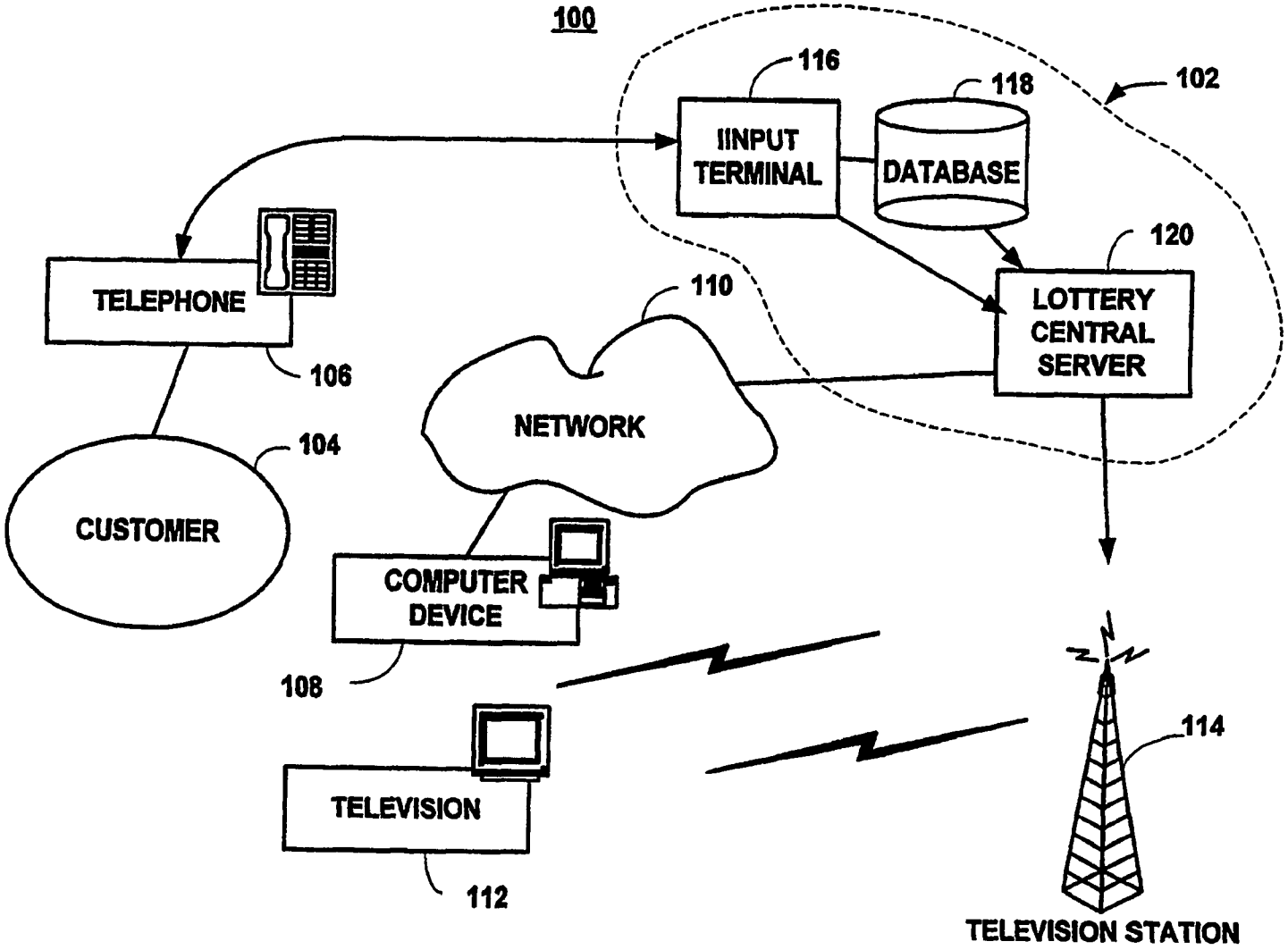
FIG. 1C is a block diagram of a jackpot lottery system in an illustrative environment wherein a customer communicates with the jackpot lottery system using a telephone, and lottery information is displayed on a television or computer device, according to an embodiment of the invention.

According to an embodiment of the invention illustrated in FIG. 1C, a block diagram 100 depicts a lottery system 102 in communication with a lottery customer 104 via telephone 106. Lottery system 102 may further comprise an input terminal 116, a database 118, and a lottery central server 120. In one implementation, a computer device 108 and/or television 112 displays updated jackpot information provided by lottery system 102. Other types of lottery information may also be displayed such as, for example, new prizes or prizes which may evolve as the number of lottery tickets sold increases (e.g., an automobile prize changes from a sub-compact to a luxury car). In this embodiment, customer 104 may use a telephone 106 as his/her remote terminal device to communicate with lottery system 102. Note that although a telephone 106 is used here, other remote terminal devices such as PCs, PDAs, cellular telephones, or other private and public remote terminal devices may also be used to communicate with lottery system 112. Customer 104 may be a current customer, a potential customer, or any other interested third party. If the customer wishes to participate in the lottery, he or she may use telephone 106 to connect to lottery system 102.

According to an embodiment, input terminal 116 may comprise an electronic device such as a computer device that processes customer orders, billing data, customer profiles, and other relevant information. Input terminal 116 may be used to facilitate the updating of information relating to lottery prizes. To communicate with lottery system 102, customer 104 may call a 900-type number (which may require a minimum fee as well as per-minute charges), an 800-type number (e.g., a toll-free number), or some other number to access lottery system 102. Once customer 104 has established a connection to system 102, he or she may transmit to input terminal 116 relevant information for participating in the lottery. The relevant information may include, for example, one or more lottery numbers provided by customer 104, the number of lottery numbers to be entered, credit card information or any other method of payment, or other information that a customer may provide. Input terminal 116 may comprise a computer device such as, for example, a personal computer (PC), server, or other computer device. Input terminal 116 may be manned by a person such as a sales representative. Alternatively, input terminal 116 may be semi or fully automated using an application such as a speech recognition system responsive to human voice, or a system that is responsive to keystrokes. According to one embodiment, a plurality of terminals 116 may be used in system 102 and may communicate with database 118 and lottery central server 120. Database 118 may also communicate with lottery central server 120.

Lottery system 102 may communicate with conventional lottery purchasing sites such as convenience stores (not shown), and may receive information relating to lottery ticket sales of conventional lottery purchasing sites. Database 118 may store various data including customer information and data relating to lottery prizes including, for instance, an updated size of a lottery jackpot. Database 118 may comprise a plurality of databases and may communicate with one or more of input terminals 116. Once customer 104 has provided relevant information (e.g., lottery numbers, payment information, etc.) for participating in the lottery, and system 102 has appropriately billed customer 104, the data stored in database 118 (e.g., data relating to jackpot size of a progressive accumulating jackpot) may be updated. System 102 may then update lottery information in the lottery central server 120, which may then disseminate the latest information relating to the lottery via network 110 and/or television station 114.

According to an embodiment of the invention, network 110 may comprise the Internet, an Intranet, a LAN, a WAN, the PSTN, or other network or a combination thereof. Further, the latest information may be distributed to third parties such as advertisers, who can then disseminate the updated information through their advertisements which may include television advertisements, web advertisements, or other forms of advertisements. The updated lottery information may then be viewed using a computer device 108, a television 112, or other display devices. Alternatively, updated lottery information may be presented in other formats such as, for example, in an audio format (e.g., radio). Updated lottery information (e.g., jackpot size) may also be shown in a ticker-type format or any other type of format compatible for showing changing data. Computer device 108 may comprise a PC, a PDA, a cellular phone, or any other device capable of displaying lottery data from lottery system 102. Television 112 may receive signals from a television station 114 via tower, cable and/or satellite transmission. The disseminated information may be viewed by a customer 104 in a number of different formats. The updated information may be displayed on its own website, on a browser, or in a third party advertisement if displayed on computer device 108. If the updated lottery data is being viewed on television 112, it may be displayed on a TV channel, a particular TV show, and/or in an advertisement commercial.

Figure 2:
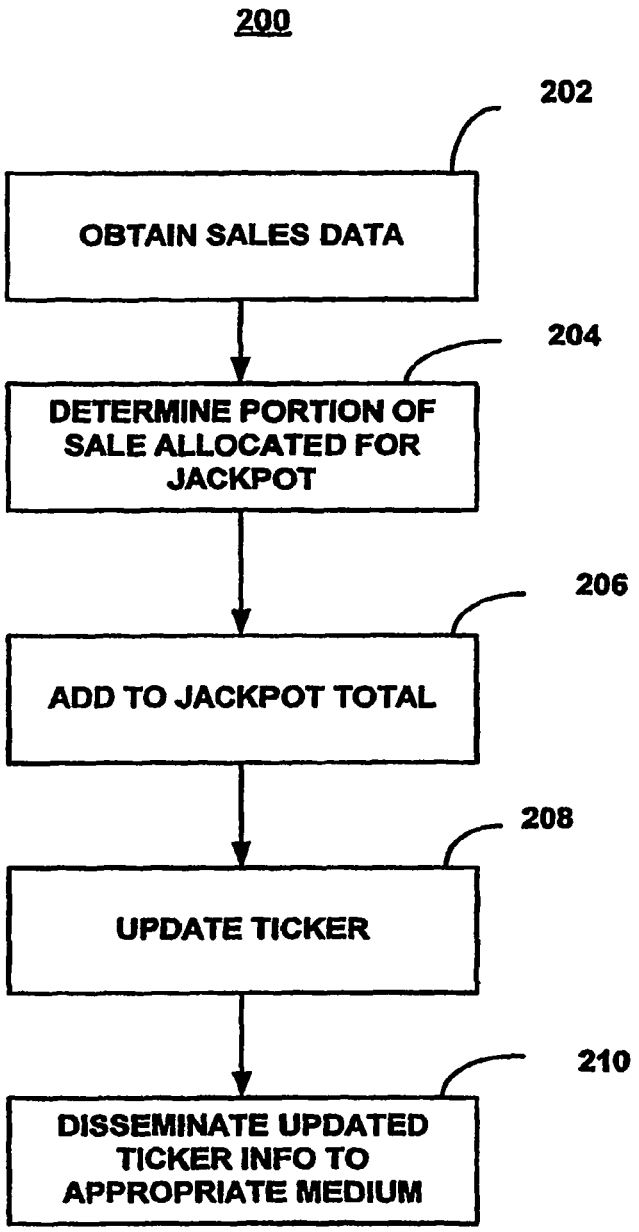
FIG. 2 is a flowchart of an illustrative process for displaying a continuously updated jackpot ticker, according to an embodiment of the invention.

In other embodiments of the invention, customers may be in communication with the lottery system 32 via a computer device. The computer device may comprise a PC, PDA, or other computer device. Using the computer device, a customer may participate in a lottery by sending an email message or other electronic communication to lottery system 32. The email message or other electronic communication may contain information for entering a lottery (e.g., lottery participation number, user password, credit card information, or other information needed for lottery participation). In another embodiment of the invention, lottery system 32 may interface with a web page server, thus allowing customers to enter a lottery via a lottery web page. The lottery web page may allow customers to directly enter relevant information for participating in a lottery through the page. The information provided by customers may then be relayed to lottery system 32 via a communication link. The communication link may comprise a network such as the Internet, an Intranet, a LAN, a Wan, the PSTN, or other networks or a combination thereof FIG. 2 is a flow diagram depicting a process 200 for updating a progressive accumulating jackpot ticker, which may be viewed in various mediums, according to one embodiment. Process 200 may comprise a continuously recurring process that may occur each time a customer contacts a lottery system to purchase a lottery number. Process 200 may begin when a customer provides relevant information relating to the purchase of a lottery participation number, in an operation 202. The lottery participation number may be the lottery number that the customer determines, and may not be a pre-determined lottery or randomly generated number as typically given to customers at conventional lottery purchasing sites. Alternatively, a customer may ask to be assigned a randomly generated number. Lottery numbers may comprise numbers, letters, other symbols, or any combination thereof that can be used for defining a lottery number. The information provided in operation 202 may include the lottery participation numbers being purchased, a user ID, credit card number, or other relevant information.

With some lotteries, the price for each chance may be set at a particular dollar amount. Thus, if a customer purchases three lottery numbers at $2 per number, the total cost for the three lottery numbers would be $6. Once the lottery system obtains the relevant information from the customer, a portion of the sale price to be allocated to the progressive jackpot may be determined in an operation 204. After the allocated portion is determined, this portion may then be added to the current jackpot total in an operation 206. Once a jackpot total has been updated, the jackpot ticker may be updated in an operation 208. After the jackpot ticker has been updated, the updated ticker information may be disseminated to the appropriate media (e.g., web browser, Internet web sites, television shows, etc.) in an operation 210.

Figure 3:
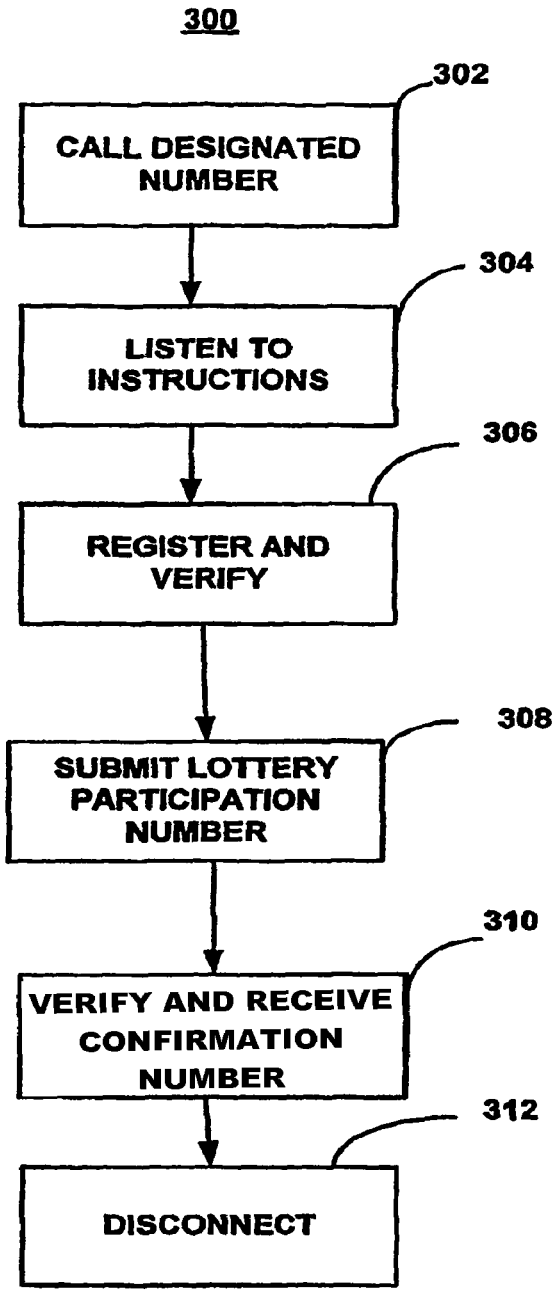
FIG. 3 is a flowchart of an illustrative process for entering a lottery via telephone, according to an embodiment of the invention.

FIG. 3 illustrates a flow diagram 300 for purchasing lottery tickets through a lottery system via telephone. In an operation 302, a customer may call a 900-type number, an 800-type number, or any other access number assigned to the lottery for call-in orders. Note that when a 900-type number is used, a minimum charge may be automatically charged to the customer's telephone account. There may also be additional per-minute charges for each minute of the telephone call. All or a portion of the minimum charge may go toward the cost of purchasing a minimum number of lottery tickets. The customer may purchase lottery tickets by providing lottery participation numbers, which may be determined by the customer. Customers may also request that the lottery randomly generate lottery numbers. If a customer wishes to purchase more lottery participation numbers, lottery numbers may automatically be allocated to the customer based on the minimum fee, and the customer may then obtain more lottery numbers by orally ordering more numbers and/or by selecting appropriate keys on the telephone key pad.

Once a customer has established a connection with the lottery system, the lottery system may provide instructions to the customer on how to participate in the lottery in an operation 304. The instructions may include, for instance, types of numbers that a caller may enter such as, for example, a 14- to 16-digit number. To communicate with a customer, the lottery system may use pre-recorded messages, a voice activated system, a person providing instructions over the phone, or a combination of all of these or other techniques. After receiving known instructions, a customer may then register with the lottery, and the lottery system may verify the identity of the customer in an operation 306. If a customer is a first-time caller, then he or she may be required to provide certain data such as credit card information, a driver's license number, password, or other relevant information. If a customer is a repeat caller, he or she may only need to submit an existing user ID and/or a password to verify identity. Once the identity of a customer is confirmed, privileges associated with the customer may be determined.

According to an embodiment, privileges may be assigned to each customer. For example, there may be a limit as to how many lottery tickets a particular customer may purchase. If a customer is a new customer, then the system may request that the new customer provide certain information such as a Social Security number, driver's license number, password (e.g., mother's maiden name, credit card number), or other relevant information. Alternatively, a customer may choose to forego the normal registration process if the customer is reluctant to provide personal information. In such a situation, the customer may still be required to provide certain information such as email address and/or credit card information.

Once a customer's identity has been verified and/or payment information has been secured, and the customer's privileges have been determined, the customer may then purchase a lottery ticket by entering the lottery participation numbers. These numbers may be entered orally, or by "selecting" the numbers on a phone key pad in an operation 308. Alternatively, the customer may request that lottery participation numbers be randomly generated. The lottery participation numbers may be any sequence of numbers, letters, or other symbols for supporting a lottery system such as, for example, a 14- to 16-digit number. The lottery participation numbers may be the numbers used to determine the jackpot or lottery prize winners. Note that there may be no need to actually purchase lottery tickets in a physical location since the entire process of customers ordering lottery tickets (e.g., lottery numbers) may be done remotely. Further, the customer alone may determine the lottery number to enter and does not have to be assigned to a randomly generated lottery number. Once a customer's lottery participation number or numbers have been entered, the system may process the entered information and update a jackpot ticker. The jackpot ticker may comprise a running count of the jackpot size. The system may then generate a confirmation for the customer verifying that the lottery participation numbers have been entered into the system in an operation 310. Confirmation that lottery participation numbers have been entered may be given orally, by pre-recorded message over the phone, by email, or by any other techniques for providing confirmations. Along with the confirmation, a confirmation number may also be provided. After submitting the lottery participation number and/or receiving the confirmation that an order has been accepted, a customer may hang-up the phone to end the session in an operation 312.

A customer using a telephone to purchase lottery tickets (and select lottery participation numbers) may be billed in a number of ways. For instance, a customer may be billed for the entire time that he is connected to the system using the 900-type number at some pre-determined rate. As described earlier, when a 900-type number is used, a minimum fee may be charged along with any additional per-minute charges. The minimum fee for a 900-type number call may be set so that a customer is entitled to a specified amount of lottery tickets. For instance, if the minimum fee is $5 and the cost of a lottery ticket is $2, then a customer buying lottery tickets over the phone may be entitled to two lottery tickets based on the minimum fee.

According to an embodiment, part of the total fees billed to a customer may be allocated to pay for the lottery ticket price, including all or a portion of any minimum fees charged. The fees charged may be charged to the caller's telephone number and telephone account. The system may also allow customers to specify the amount of a wager being placed on one or more lottery participation numbers that are entered.

If a customer is accessing the lottery system using an 800-type number or a local access number, then billing may be done entirely over the telephone. That is, the customer may specify an amount he/she wishes to wager, along with the one or more lottery participation numbers that he/she wishes to enter into the lottery system. Further, payment information such as credit card number, money order, and other payment information, may be provided during the call.

The lottery system may disseminate data relating to progressive jackpots to the public in a ticker-type format. A ticker-type format is a format wherein changing data is shown as a "ticker" on a display such as a television monitor. For instance, a ticker-type format may comprise a scrolling display of current or recent figures relating to, for example, stock prices, sports scores, weather, and other types of information that may be of interest to the public. Such displays are commonly seen on, for example, billboards and television programs. An updated jackpot ticker may be viewed by the public in many places continuously, semi-continuously, or on some other pre-determined basis. For instance, if updated progressive jackpot information is to be displayed in a ticker-type format, it may be placed into a web browser, an Internet advertisement, a web page, a television program, a television channel, a television commercial, billboards, stadium scoreboards, or other media channels. This may encourage the public to pay more attention to the media that the information is being displayed through. For instance, computer users may be encouraged to use a particular web browser that shows the ticker, or may actually pique the interest of computer users to actually look at web ads that pop-up on the user interface. According to an embodiment, a web page dedicated to the lottery may also display the ticker continuously. If the ticker is to be displayed via television, it may be shown during a program running across the top or bottom of a screen. The ticker may also be assigned to a particular channel and may run constantly or during certain time periods. Television commercials may also show the ticker. The updated jackpot information may also be shown on a periodic basis. For example, announcements or displays of the latest amount of the jackpot may be made on a television or radio show on an hourly, daily, weekly, monthly, or other periodic basis. Other techniques for disseminating lottery information may also be used. For instance, radio or other audio-type communication devices may also be used to disseminate such information on a continuous and/or periodic basis.

Figure 4:
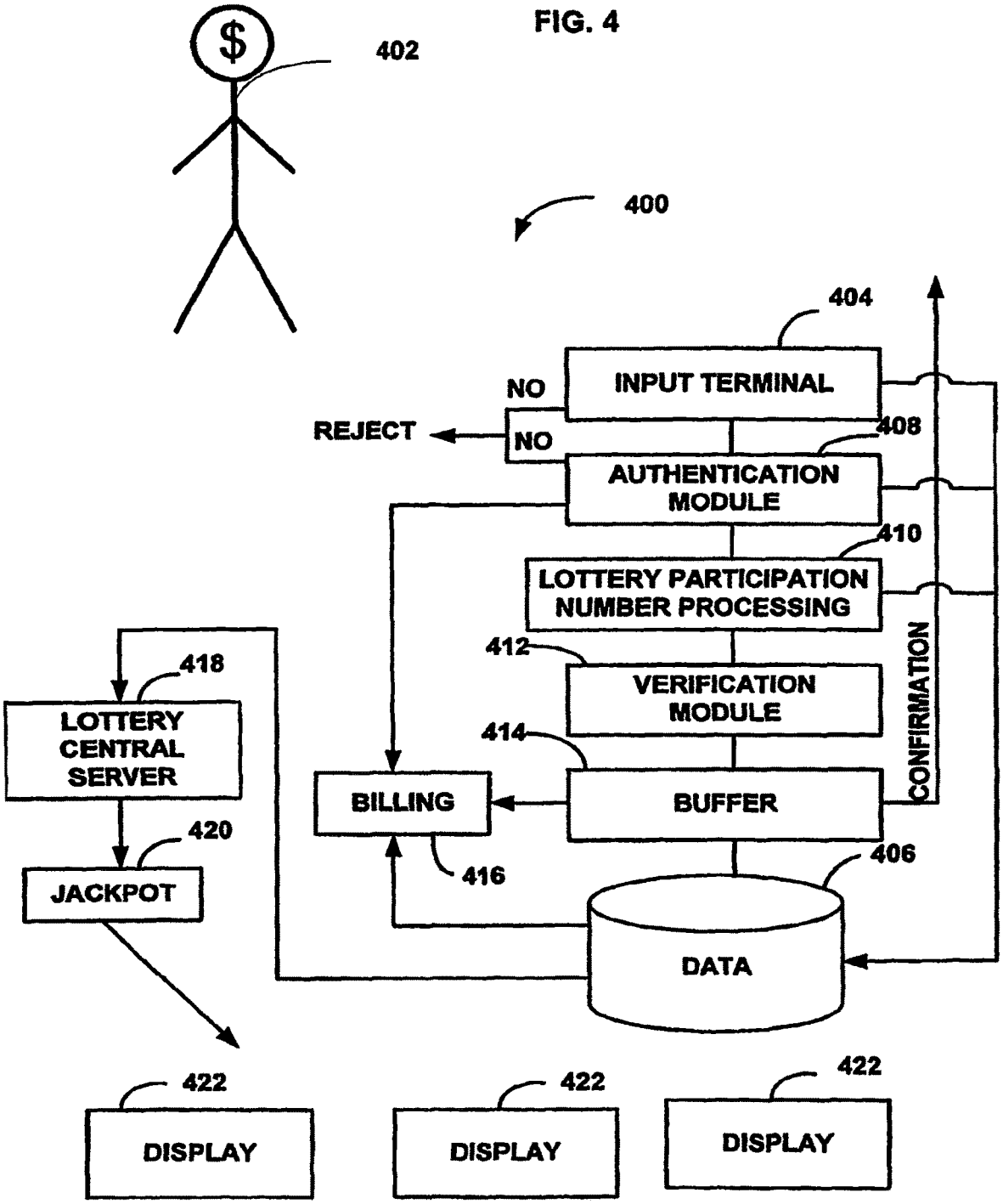
FIG. 4 is a block diagram of a lottery system that uses a non-900 number for call-in purchasing of one or more lottery tickets, according to an embodiment of the invention.

FIG. 4 illustrates a block diagram depicting an architecture 400 of a lottery system 32 according to one embodiment of the invention. The architecture 400 depicted represents the system architecture 400 of a lottery system 32 that may be accessible using both a non-telephonic remote terminal (e.g., PCs, PDAs, and other communication devices), as well as a telephone. When a customer 402 initially contacts system 32, information provided by customer 402 may be entered through a remote terminal (not shown) which may send the information through a communication link (not shown) and to an input terminal 404. Input terminal 404 may initially screen all incoming messages or calls (e.g., a request for purchasing a lottery ticket) and may reject the messages or calls which may not meet the initial screening requirements. A message or a call may be rejected for several reasons including, for example, crank messages or calls, incorrectly addressed messages or wrong-number calls, messages and calls made by persons not authorized to participate in the lottery, or for other reasons. Information provided to input terminal 404 may be further processed against information stored in a database 406 to determine whether to reject the call or message from customer 402. For instance, system 102 may maintain a record of past callers who have provided bad billing information. Any new information provided by a customer 402 may be stored in database 406. The information (e.g., user ID, password, driver's license, credit card number, etc.) provided by customer 402 may be reviewed for verification by authentication module 408.

Authentication module 408 may use the data stored in database 406 (which may store customer profile data) to verify the identity of the caller (e.g., user ID and password). If initial information provided by caller 402 fails the authorization process, the system 32 may not allow the customer 402 to participate in the lottery. Accordingly, the call or message may be rejected.

A lottery participation number processing module 410 may enable a customer to enter a lottery participation number of the customer's choosing, and may process the participation number for storage in database 406, which may store the lottery numbers entered by callers.

A verification module 412 may provide a confirmation to the customer that the customer's lottery number has been successfully entered. A buffer 414 may temporarily hold certain data including, for example, an order confirmation which confirms that a customer's order has been recorded with system 32.

A billing module 416 may be used to keep track of billings and to bill appropriate customers. Database 406 may store the running total of the lottery jackpot. Alternatively, or in conjunction with database 406, the lottery central server may also keep a running total of the lottery jackpot. A lottery central server 418 may take the running total of the jackpot and disseminate the updated total jackpot 420 to one or more displays. The public may then view the updated jackpot total through various displays 422.

Figure 5:
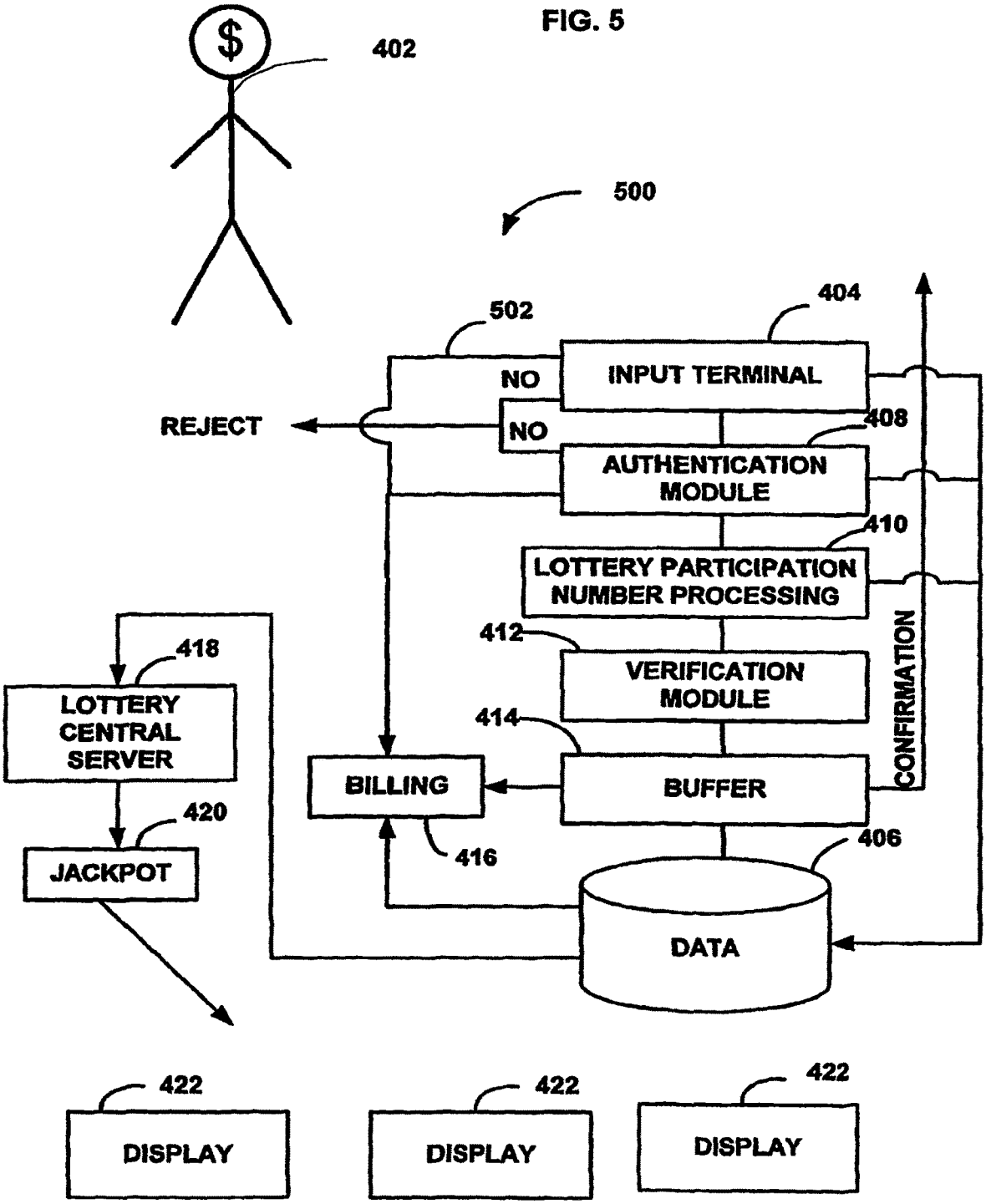
FIG. 5 is a block diagram of a lottery system that uses a 900 number for call-in purchasing of one or more lottery tickets, according to an embodiment of the invention.

FIG. 5 illustrates a block diagram depicting an architecture 500 of a system 32 according to an embodiment of the invention. Architecture 500 represents a system architecture that may be implemented if lottery system 32 is accessible by a 900-type telephone number. Note that system architecture 500 as depicted here is identical to system architecture 400 of FIG. 4, except that billing of customers may occur as soon as a customer is connected to the 900 number as indicated by 501.

Figure 6:
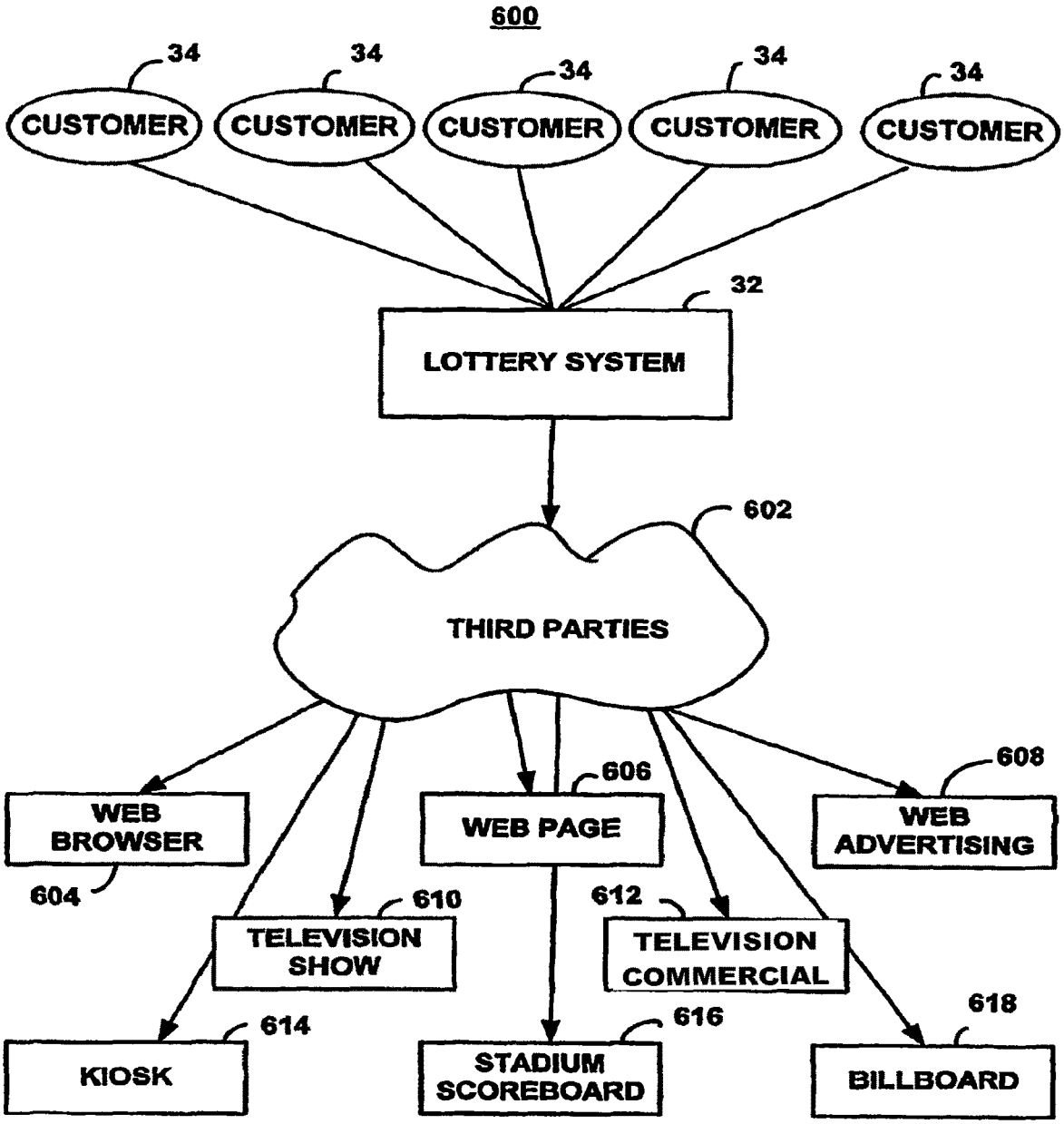
FIG. 6 is a block diagram of a lottery system that disseminates information relating to a progressive jackpot to third parties, according to an embodiment of the invention.

FIG. 6 illustrates data relating to a progressive jackpot to third parties 602. Lottery system 32 may sell lottery tickets (e.g., lottery participation numbers) to customers 34 for a progressive jackpot. As more tickets are sold, the progressive jackpot may increase. As the jackpot size increases, lottery system 32 may provide updated jackpot information to third parties 602. Third parties 602 may then display the information in various mediums such as a web browser 604, a web page 606, a web advertising 608, a television show 620, television commercial 612, a kiosk 614, a stadium scoreboard 616, or a billboard 618. Alternatively, lottery system 32 may provide jackpot information directly to various mediums without going through third parties 602.

Although particular embodiments of the invention have been shown and described, it will be understood that it is not intended to limit the invention to the embodiments disclosed.

For example, and with reference to FIG. 1A, system 12 may be used to collect and disseminate information in various environments. For instance, system 12 may be used to collect viewer voting data from television viewers of a reality television show, and to display a running count of the results throughout the television show.

In another example, system 12 may be used to collect votes during an election and to display the running counts of the election in real time. In such a situation, voters may be required to provide specific information to confirm the user's identity and to determine voters' privileges.

System 12 may have many other uses especially when there is a need to collect and process data from the public and to disseminate the results to the public in real-time. Accordingly, changes and modifications may be made without departing from the spirit and scope of the invention. Thus, the invention is intended to cover alternatives, modifications, and equivalents, which may be included within the spirit and scope of the invention as defined by the claims.

A further aspect of the present invention comprises a data processing system including:

an input terminal operable to receive data from a telecommunications network;

a data storage means for storing data; and a server operable to communicate with a presentation device;

wherein said data processing system is configured to store a value having at least partial dependence on said received data;

said data processing system configured to update automatically said value responsive to and on at least partial dependence on the most recent data received by said input terminal; and configured to communicate said updated value to said presentation device automatically.

A yet further aspect comprises a method of operating a data processing system, comprising:

receiving data from a telecommunications network;

responsive to receiving said data automatically updating a value in partial dependence on said data; and automatically communicating said updated value to a presentation device.

In particular, updating the value comprises increasing the value. This is particularly suitable for implementing a lottery system in which the value is updated corresponding to lottery sales amount data.

For example, a portion of any lottery entry (e.g., tickets) sales amounts could be added to the value, which itself represents a lottery prize fund or winning amount (e.g., a jackpot).

Optionally, the value represents the number of votes recorded in a vote. The number of votes could be in respect of the number of votes cast for a particular individual or thing, or the difference in votes cast between two entities.

Insofar as embodiments of the invention described above are implementable, at least in part, using a computer system, it will be appreciated that a computer program for implementing at least part of the described methods and/or the described systems, is envisaged as an aspect of the present invention. The computer system may be any suitable apparatus, system or device. For example, the computer system may a programmable data processing apparatus, a general purpose computer, a Digital Signal Processor or a microprocessor. The computer program may be embodied as source code and undergo compilation for implementation on a computer, or may be embodied as object code, for example.

Suitably, the computer program can be stored on a carrier medium in computer usable form, which is also envisaged as an aspect of the present invention. For example, the carrier medium may be solid-state memory, optical or magneto-optical memory such as a readable and/or writable disk for example a compact disk and a digital versatile disk, or magnetic memory such as disc or tape, and the computer system can utilise the program to configure it for operation. The computer program may be supplied from a remote source embodied in a carrier medium such as an electronic signal, including radio frequency carrier wave or optical carrier wave.

In view of the foregoing description of particular embodiments of the invention it will be appreciated by a person skilled in the art that various additions, modifications and alternatives thereto may be envisaged.

What is claimed is:

1. A system coupled to a communication link, the system comprising: one or more servers; and processing circuitry configured to:

receive, from the communication link, identification information identifying a user, the identification information having been sent from a cellphone used by the user;

maintain a bad-billing list of users, wherein each user on the list is a person who has previously provided incorrect billing information;

determine, in accordance with (a) the identification information and (b) the bad-billing list, whether or not to permit entry of the user into a lottery having a prize, such that if the user is on the bad-billing list, the processing circuitry will not permit entry of the user;

verify an identity of the user in accordance with the received identification information;

determine, after the processing circuitry has verified the user's identity and in accordance with the received identification information, a lottery participation privilege for the user, the lottery participation privilege, assigned to the user by the system, determining whether there is a limit on how many entries into a lottery the user is permitted to have;

enter the user into the lottery in accordance with the determination that the user is permitted to enter the lottery and further based on a determination of the lottery participation privilege of the user;

update the prize for the lottery in response to entry, of the user into the lottery; and effect display, on a display screen coupled with the one or more servers, regarding the updated prize, wherein at least one of the following conditions is satisfied:

(1) wherein the system is configured to receive the identification information via a call from the cellphone to a 900 number, and wherein funds obtained from a 900 number fee are applied to purchase of a lottery entry;

(2) wherein the processing circuitry is further configured to effect display of the updated jackpot prize on a stadium scoreboard;

(3) wherein the processing circuitry is further configured to effect display of the updated jackpot prize on a display during a television program;

(4) wherein the processing circuitry is further configured to effect display of the updated jackpot prize via a running ticker displayed during a television show;

(5) wherein the processing circuitry is further configured to effect display of the updated jackpot prize via a television commercial;

(6) wherein the processing circuitry is further configured to effect display of the updated jackpot prize on an elevator display;

(7) wherein the processing circuitry is further configured to effect display of the updated jackpot prize on a gas pump;

(8) wherein the identification information comprises (a) a customer ID and (b) a password, and wherein the processing circuitry is further configured to receive, from the cellphone, one of (i) a lottery number selected by the user, and (ii) a request that a randomly-generated lottery number be used for the lottery ticket;

(9) wherein the identification information comprises (a) a customer ID and (b) a password, and wherein the processing circuitry is further configured to receive, from the cellphone, wager information comprising (a) a number of lottery tickets desired to be purchased by the user, and (b) for each lottery ticket desired to be purchased by the user, one of (i) a lottery number selected by the user, and (ii) a request that a randomly-generated lottery number be used for the lottery ticket;

(10) wherein the processing circuitry is further configured to determine whether or not a user is a new user, and to, in response to a determination that the user is a new user, request, from the user, information comprising a social security number, a driver's license number, and credit card information:

(11) wherein the identification information is received via an e-mail message from the user;

(12) wherein the identification information and one of (i) a lottery number selected by the user, and (ii) a request that a randomly-generated lottery number be used for the lottery ticket are received by the system via an e-mail message;

(13) wherein the system is configured to receive from the cellphone an e-mail message comprising a desired lottery number selected by the user and credit card information; and

(14) one of the following two conditions is satisfied: (a) wherein the system is further configured to generate, in response to purchase of a lottery ticket by a user, an e-mail confirmation comprising a confirmation number, and (b) wherein the system is further configured to generate, in response to purchase of a lottery ticket by a user, a telephonic confirmation comprising a confirmation number, wherein the processing circuitry is further configured to effect display of the updated jackpot prize on a billboard, wherein the system is further configured to allocate a portion of a sales price of a lottery entry to a progressive jackpot, wherein entry by the user into the lottery is carried out in accordance with speech recognition of the user's speech, wherein the processing circuitry is further configured to effect transmission of the updated jackpot prize via radio, and wherein the system is further configured to receive, from the cellphone, payment information for a lottery entry, the payment information comprising credit card information.

2. The system according to claim 1, wherein the processing circuitry is configured to effect, via radio, the transmission regarding the updated prize.

3. The system according to claim 1, wherein condition (1) is satisfied.

4. The system according to claim 1, wherein condition (2) is satisfied.

5. The system according to claim 1, wherein condition (3) is satisfied.

6. The system according to claim 1, wherein condition (4) is satisfied.

7. The system according to claim 1, wherein condition (5) is satisfied.

8. The system according to claim 1, wherein condition (6) is satisfied.

9. The system according to claim 1, wherein condition (7) is satisfied.

10. The system according to claim 1, wherein condition (8) is satisfied.

11. The system according to claim 1, wherein condition (9) is satisfied.

12. The system according to claim 1, wherein condition (10) is satisfied.

13. The system according to claim 1, wherein condition (11) is satisfied.

14. The system according to claim 1, wherein condition (12) is satisfied.

15. The system according to claim 1, wherein condition (13) is satisfied.

16. The system according to claim 1, wherein condition (14) is satisfied.

17. The system according to claim 1, wherein conditions (1) through (7) are satisfied.

18. The system according to claim 17, wherein conditions (8) or (9) are satisfied.

19. The system according to claim 18, wherein condition (9) is satisfied.

20. The system according to claim 19, wherein at least one of conditions (11) through (13) are satisfied.

21. The system according to claim 20, wherein condition (14) is satisfied.

22. The system according to claim 19, wherein conditions (11) and (13) are satisfied.

23. The system according to claim 22, wherein condition (14) is satisfied.

24. The system according to claim 19, wherein condition (14) is satisfied.

25. The system according to claim 19, wherein condition (10) is satisfied.

26. The system according to claim 1, wherein the prize for the lottery does not take into account any retail store lottery ticket sale.

27. The system according to claim 1, wherein the processing circuitry is further configured to update and display, in real-time, a jackpot ticker including a running count of the jackpot size, based on an accumulation of transaction confirmations from one or more users, and wherein the system is further configured to reject a message or a call initiated at a mobile device associated with the user, in response to the user identification information and the lottery participation information being indicative of a user that has exceeded a number of lottery entries or is not authorized to enter the lottery.

28. A system coupled to a communication link, the system comprising:

one or more servers; and processing circuitry configured to:

receive, from the communication link, identification information identifying a user, the identification information having been sent from a cellphone used by the user;

maintain a bad-billing list of users, wherein each user on the list is a person who has previously provided incorrect billing information;

determine, in accordance with (a) the identification information and (b) the bad-billing list, whether or not to permit entry of the user into a lottery having a prize, such that if the user is on the bad-billing list, the processing circuitry will not permit entry of the user;

verify an identity of the user in accordance with the received identification information;

determine, after the processing circuitry has verified the user's identity and in accordance with the received identification information, a lottery participation privilege for the user, the lottery participation privilege, assigned to the user by the system, determining whether there is a limit on how many entries into a lottery the user is permitted to have;

enter the user into the lottery in accordance with the determination that the user is permitted to enter the lottery and further based on a determination of the lottery participation privilege of the user;

update the prize for the lottery in response to entry, of the user into the lottery; and effect display, on a display screen coupled with the one or more servers, regarding the updated prize, wherein at least one of the following conditions is satisfied:

(1) wherein the system is configured to receive the identification information via a call from the cellphone to a 900 number, and wherein funds obtained from a 900 number fee are applied to purchase of a lottery entry:

(2) wherein the processing circuitry is further configured to effect display of the updated jackpot prize on a stadium scoreboard;

(3) wherein the processing circuitry is further configured to effect display of the updated jackpot prize on a display during a television program;

(4) wherein the processing circuitry is further configured to effect display of the updated jackpot prize via a running ticker displayed during a television show;

(5) wherein the processing circuitry is further configured to effect display of the updated jackpot prize via a television commercial;

(6) wherein the processing circuitry is further configured to effect display of the updated jackpot prize on an elevator display;

(7) wherein the processing circuitry is further configured to effect display of the updated jackpot prize on a gas pump;

(8) wherein the identification information comprises (a) a customer ID and (b) a password, and wherein the processing circuitry is further configured to receive, from the cellphone, one of (i) a lottery number selected by the user, and (ii) a request that a randomly-generated lottery number be used for the lottery ticket;

(9) wherein the identification information comprises (a) a customer ID and (b) a password, and wherein the processing circuitry is further configured to receive, from the cellphone, wager information comprising (a) a number of lottery tickets desired to be purchased by the user, and (b) for each lottery ticket desired to be purchased by the user, one of (i) a lottery number selected by the user, and (ii) a request that a randomly-generated lottery number be used for the lottery ticket;

(10) wherein the processing circuitry is further configured to determine whether or not a user is a new user, and to, in response to a determination that the user is a new user, request, from the user, information comprising a social security number, a driver's license number, and credit card information;

(11) wherein the identification information is received via an e-mail message from the user:

(12) wherein the identification information and one of (i) a lottery number selected by the user, and (ii) a request that a randomly-generated lottery number be used for the lottery ticket an received by the system via an e-mail message;

(13) wherein the system is configured to receive from the cellphone an e-mail message comprising a desired lottery number selected by the user and credit card information; and

(14) one of the following two conditions is satisfied: (a) wherein the system is further configured to generate, in response to purchase of a lottery ticket by a user, an e-mail confirmation comprising a confirmation number, and (b) wherein the system is further configured to generate, in response to purchase of a lottery ticket by a user, a telephonic confirmation comprising a confirmation number, and wherein conditions (1) and (14) are satisfied, and wherein entry by the user into the lottery is carried out in accordance with speech recognition of the user's speech.

* * * * *